US009217365B2

(12) United States Patent
Lippitt et al.

(10) Patent No.: US 9,217,365 B2
(45) Date of Patent: Dec. 22, 2015

(54) INVERTED V-8 INTERNAL COMBUSTION ENGINE AND METHOD OF OPERATING THE SAME MODES

(71) Applicants: Raymond F. Lippitt, Smithfield, NC (US); Kevin S. Sweeney, Fairview Heights, IL (US)

(72) Inventors: Raymond F. Lippitt, Smithfield, NC (US); Kevin S. Sweeney, Fairview Heights, IL (US)

( * ) Notice: Subject to any disclaimer, the term of this patent is extended or adjusted under 35 U.S.C. 154(b) by 0 days.

(21) Appl. No.: 14/291,636

(22) Filed: May 30, 2014

(65) Prior Publication Data

US 2015/0136069 A1 May 21, 2015

Related U.S. Application Data

(63) Continuation-in-part of application No. PCT/US2013/070387, filed on Nov. 15, 2013.

(51) Int. Cl.
*F02B 75/22* (2006.01)
*F02B 75/18* (2006.01)

(52) U.S. Cl.
CPC ..... *F02B 75/228* (2013.01); *F02B 75/1896* (2013.01)

(58) Field of Classification Search
CPC ..... F02M 35/116; F02M 35/10216; F02B 75/22; F02B 75/125; F02B 2275/30; F02B 25/28; F02B 75/228; F02D 41/30
USPC ..... 123/54.7, 54.8, 52.3, 58.1, 311, 294, 123/300, 406.47, 445, 350; 701/101–104
See application file for complete search history.

(56) References Cited

U.S. PATENT DOCUMENTS 1,468,819 A * 9/1923 Knudsen ..... 123/51 BA
1,681,910 A 8/1928 Slaght (Continued)

FOREIGN PATENT DOCUMENTS

GB 301677 12/1928

OTHER PUBLICATIONS

International Search Report for PCT/US2013/070387 dated Apr. 21, 2014.

(Continued)

*Primary Examiner* — Lindsay Low
*Assistant Examiner* — Long T Tran
(74) *Attorney, Agent, or Firm* — Pillsbury Winthrop Shaw Pittman, LLP

(57) ABSTRACT

An internal combustion engine having two banks of four piston and cylinder assemblies arranged in an inverted V configuration so that there are four pairs of assemblies each pair having cylinders with adjacent combustion chambers intercommunicated by a passage extending therebetween. Crank shaft driven pistons in said cylinders movable within the combustion chambers thereof through successive cycles each including a compression stroke followed immediately by a power drive stroke. Computer controlled fuel injectors are capable of being selectively controlled to operate either to inject fuel into (1) both cylinders of a pair to establish therein a double fire single expansion mode, or (2) into only one cylinder of a pair to establish therein a single fire double expansion mode with the one cylinder receiving the injection being alternated between the pair every predetermined number of piston cycles. A method of operating the engine as a prime mover of a vehicle having a cruise control system manually actuated to effect automatic movement of a normally manually moved accelerator pedal either in (1) a normal mode wherein the amount of fuel injected is maintained substantially that an optimum level and power variation is obtained in response to manual pedal movements by varying the relative number of injector pairs operating in modes (1) or (2) in a cruise control mode wherein all four injector pairs operate in mode (2) and power variation is obtained in response to automatic and pedal movements by varying the amount of fuel injected.

6 Claims, 8 Drawing Sheets

(56) References Cited

U.S. PATENT DOCUMENTS

| | | | | |
|---|---|---|---|---|
| 2,137,941 | A * | 11/1938 | William et al. | 123/51 R |
| 2,269,948 | A | 1/1942 | Mallory | |
| 2,439,073 | A * | 4/1948 | Butterfield | 123/195 R |
| 2,468,976 | A * | 5/1949 | Herreshoff et al. | 123/54.8 |
| 3,472,212 | A | 10/1969 | Chamberlain | |
| 3,623,463 | A | 11/1971 | Vries | |
| 3,880,126 | A | 4/1975 | Thurston et al. | |
| 4,170,970 | A | 10/1979 | McCandless | |
| 4,172,434 | A | 10/1979 | Coles | |
| 4,250,850 | A | 2/1981 | Ruyer | |
| 4,955,328 | A | 9/1990 | Sobotowski | |
| 5,022,353 | A | 6/1991 | Kamamura | |
| 5,555,871 | A * | 9/1996 | Gopp et al. | 123/481 |
| 6,209,495 | B1 | 4/2001 | Warren | |
| 6,334,435 | B1 * | 1/2002 | Negre et al. | 123/559.1 |
| 6,338,328 | B1 | 1/2002 | Mower et al. | |
| 6,363,907 | B1 | 4/2002 | Arai et al. | |
| 6,978,204 | B2 | 12/2005 | Surnilla et al. | |
| 6,988,471 | B2 | 1/2006 | Chang | |
| 6,994,057 | B2 | 2/2006 | Loth et al. | |
| 7,080,615 | B2 | 7/2006 | Shinogle | |
| 7,219,634 | B2 | 5/2007 | Hitomi et al. | |
| 7,383,797 | B2 | 6/2008 | Tour | |
| 7,578,267 | B2 | 8/2009 | Hofbauer et al. | |
| 7,584,724 | B2 * | 9/2009 | Berger | 123/48 R |
| 7,597,084 | B2 * | 10/2009 | Vachon et al. | 123/294 |
| 7,685,988 | B2 | 3/2010 | Almkvist et al. | |
| 7,823,547 | B2 | 11/2010 | Forner, Sr. et al. | |
| 7,954,472 | B1 | 6/2011 | Sturman | |
| 7,958,864 | B2 | 6/2011 | Sturman | |
| 8,006,656 | B2 | 8/2011 | Branyon et al. | |
| 8,051,811 | B2 | 11/2011 | Phillips | |
| 8,132,546 | B2 | 3/2012 | Surnilla | |
| 8,156,904 | B2 | 4/2012 | Giannini et al. | |
| 8,443,769 | B1 | 5/2013 | Lippitt | |
| 8,899,193 | B2 | 12/2014 | Lippitt et al. | |
| 9,026,339 | B1 | 5/2015 | Sturman | |
| 2002/0033167 | A1 * | 3/2002 | Hiraku et al. | 123/456 |
| 2005/0022755 | A1 | 2/2005 | Hitomi | |
| 2005/0109302 | A1 * | 5/2005 | Tetsuno et al. | 123/179.5 |
| 2006/0102124 | A1 | 5/2006 | Calderwood | |
| 2008/0029057 | A1 | 2/2008 | Hergart et al. | |
| 2009/0020103 | A1 * | 1/2009 | Van Avermaete | 123/48 D |
| 2009/0145396 | A1 | 6/2009 | Almkvist et al. | |
| 2009/0183699 | A1 | 7/2009 | Sturman | |
| 2010/0050978 | A1 | 3/2010 | Hofbauer | |
| 2010/0056327 | A1 | 3/2010 | Hofbauer | |
| 2010/0229806 | A1 | 9/2010 | Kemeny | |
| 2010/0229836 | A1 | 9/2010 | Hofbauer et al. | |
| 2010/0284824 | A1 | 11/2010 | Hippen et al. | |
| 2010/0308685 | A1 | 12/2010 | Hippen et al. | |
| 2010/0326394 | A1 | 12/2010 | Hofbauer | |
| 2011/0022289 | A1 | 1/2011 | Hofbauer | |
| 2011/0057049 | A1 | 3/2011 | Hofbauer et al. | |
| 2011/0215575 | A1 | 9/2011 | Hofbauer et al. | |
| 2011/0220080 | A1 | 9/2011 | Meldolesi et al. | |
| 2011/0241473 | A1 | 10/2011 | Hippen et al. | |
| 2011/0251773 | A1 | 10/2011 | Sahandiesfanjani et al. | |
| 2011/0290207 | A1 * | 12/2011 | Kaufman et al. | 123/1 A |
| 2012/0073538 | A1 | 3/2012 | Hofbauer | |
| 2012/0085302 | A1 | 4/2012 | Cleeves | |
| 2012/0085305 | A1 | 4/2012 | Cleeves et al. | |
| 2012/0103314 | A1 * | 5/2012 | Jackson et al. | 123/70 R |
| 2015/0136069 | A1 | 5/2015 | Lippitt | |
| 2015/0136083 | A1 | 5/2015 | Lippitt | |
| 2015/0142291 | A1 | 5/2015 | Lippitt et al. | |
| 2015/0167548 | A1 | 6/2015 | Lippitt | |

OTHER PUBLICATIONS

Split Cycle Engine, obtained from url: <http://en.wikipedia.org/wiki/Split_cycle_engine> on Apr. 26, 2012.

Scuderi Engine, obtained from url: <http://en.wiklpedia.org/wiki/Scuderi_Engine> on Apr. 26, 2012.

EcoMotors International Technology, obtained from url: <http://www.ecomotors.com/technology> on May 10, 2012.

International Search Report and Written Opinion dated Aug. 18, 2015 for Appln. No. PCT/US2016/033661.

International Preliminary Report on Patentability dated Sep. 15, 2015 for Appln. No. PCT/US2013/070387.

* cited by examiner

| | PAIR 1 | | | | PAIR 2 | | | | PAIR 3 | | | | PAIR 4 | | | |
|---|---|---|---|---|---|---|---|---|---|---|---|---|---|---|---|---|
| | BKL | | BKR | | BKL | | BKR | | BKL | | BKR | | BKL | | BKR | |
| CR | CE | PM | CE | PM | CE | PM | CE | PM | CE | PM | CE | PM | CE | PM | CE | PM |
| 0° | F | D | F | D | E | U | E | U | C | U | C | U | I | D | I | D |
| 180° | E | U | E | U | I | D | I | D | F | D | F | D | C | U | C | U |
| 360° | I | D | I | D | C | U | C | U | E | U | E | U | F | D | F | D |
| 540° | C | U | C | U | F | D | F | D | I | D | I | D | E | U | E | U |
| 720° | | | | | | | | | | | | | | | | |

INVERTED V-8 INTERNAL COMBUSTION ENGINE AND METHOD OF OPERATING THE SAME MODES

CROSS-REFERENCE TO RELATED APPLICATIONS

This application is a continuation-in-part of International Patent Application No. PCT/US2013/070387, filed Nov. 15, 2013, the entire contents of which are incorporated herein by reference in its entirety.

FIELD OF INVENTION

This invention relates to internal combustion engines and more particularly to engines having fuel saving operating modes of the type disclosed in U.S. Pat. No. 8,443,769.

BACKGROUND OF THE INVENTION

The fuels saving modes of the '769 Patent involve a step forward in the evolution of "skipping" technology. For the first time, the piston of the skipped piston and cylinder assembly actually enters into the creation of power rather than simply being neutral or requiring power from the rest of the engine to be moved through repeated cycles without cycle events taking place. The skipped piston enters into the creation of power because it shares combustion chambers of two paired assemblies. By means of a passage between the combustion chambers, the increased pressure conditions in the cylinder of its paired assembly resulting from the internally fired power drive stroke therein causes the associate pistons of the cylinder to undergo a simultaneous shared power drive stroke. Since the skipped piston is directly connected to the crankshaft, its shared power drive stroke creates power in the engine. A feature of the '769 patent is that the fuel injectors of the paired assemblies are computer controlled so to select whether only one of the two injectors is skipped in which case the shared power stroke takes place or (2) neither injector is skipped in which normal operation takes place. For convenience of language, these selectable modes of operation can be identified as (1) a single fire double expansion and (2) a double fire single expansion respectively.

BRIEF DESCRIPTION OF THE INVENTION

A nonlimiting object of the present invention is to provide an engine configuration which optimizes the pairs of pistons and cylinders that can be selectively operated. In accordance with the principal of the present invention, this objective is obtained by providing an internal combustion engine having two banks of four piston and cylinder assemblies arranged in an inverted V configuration so that there are four pairs of assemblies, each pair having cylinders with adjacent combustion chambers intercommunicated by a passage extending therebetween. Crank shaft driven pistons in said cylinders are movable within the combustion chambers thereof through successive cycles each including a compression stroke followed immediately by a power drive stroke. Computer controlled fuel injectors are capable of being selectively controlled to operate either to inject fuel into both cylinders of a pair to establish therein a double fire single expansion mode (1), or into only one cylinder of a pair to establish therein a single fire double expansion mode (2). Preferably when in mode 2, the one cylinder receiving the injection is alternated between the pair every pre-determined number of piston cycles.

The present invention also includes a method of operating the inverted V-8 engine as a prime mover of a vehicle having a cruise control system manually actuated to effect automatic movement of a normally manually moved accelerator pedal either in (1) a normal mode wherein the amount of fuel injected is maintained substantially at an optimum level and power variation is obtained in response to manual pedal movements by varying the relative number of injector pairs operating in modes (1), or (2) in a cruise control mode wherein all four injector pairs operate in mode (2) and power variation is obtained in response to automatic pedal movements by varying the amount of fuel injected.

Other objects, features, and advantages of the present invention will become apparent from the following detailed description, the accompanying drawings, and the appended claims.

DETAILED DESCRIPTION OF THE INVENTION

Figure 1:
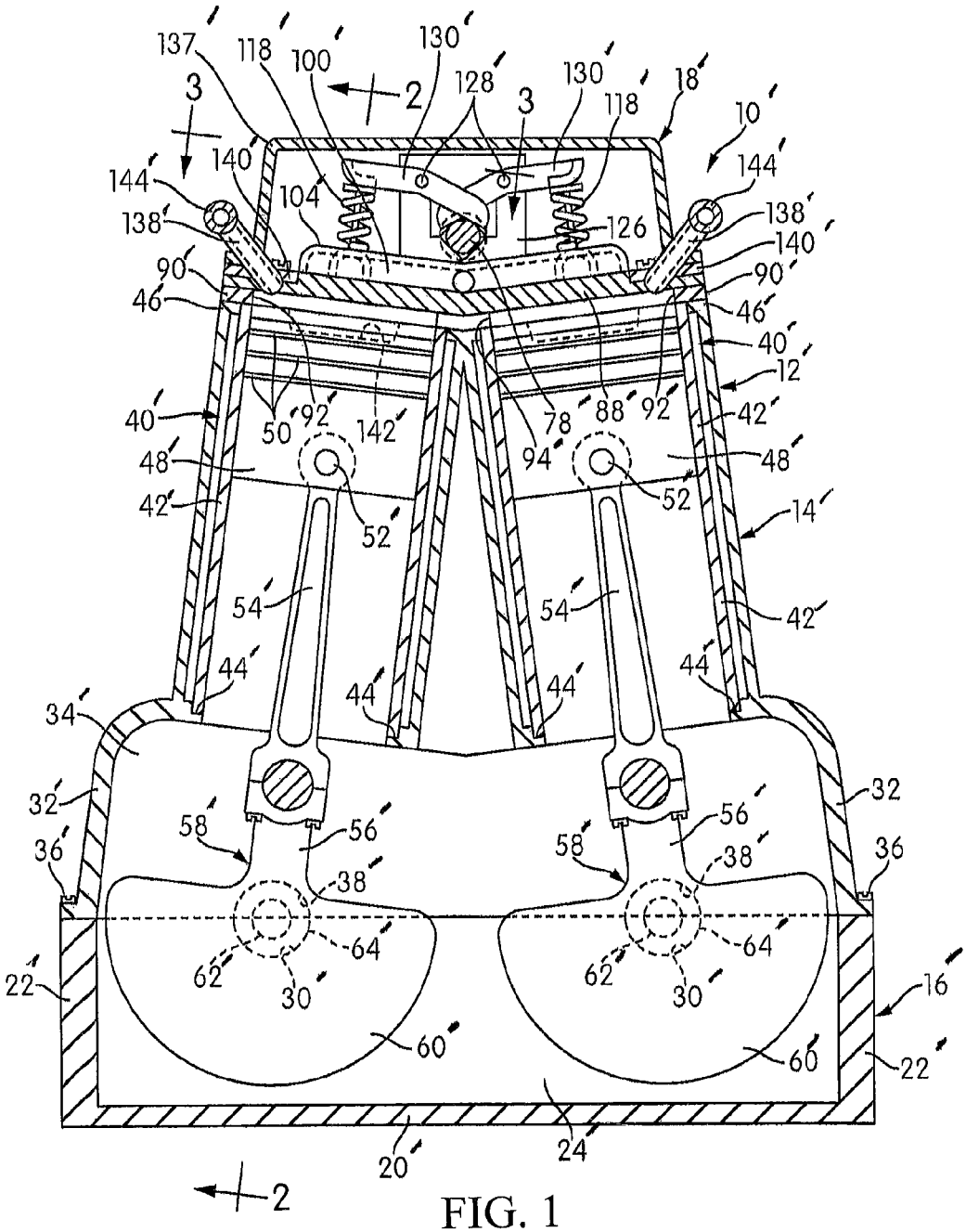
FIG. 1 is a sectional view through the center lines of two piston and cylinder assemblies of the two banks of four in an inverted V-8 engine embodying the principles of the present invention.
Figure 2:
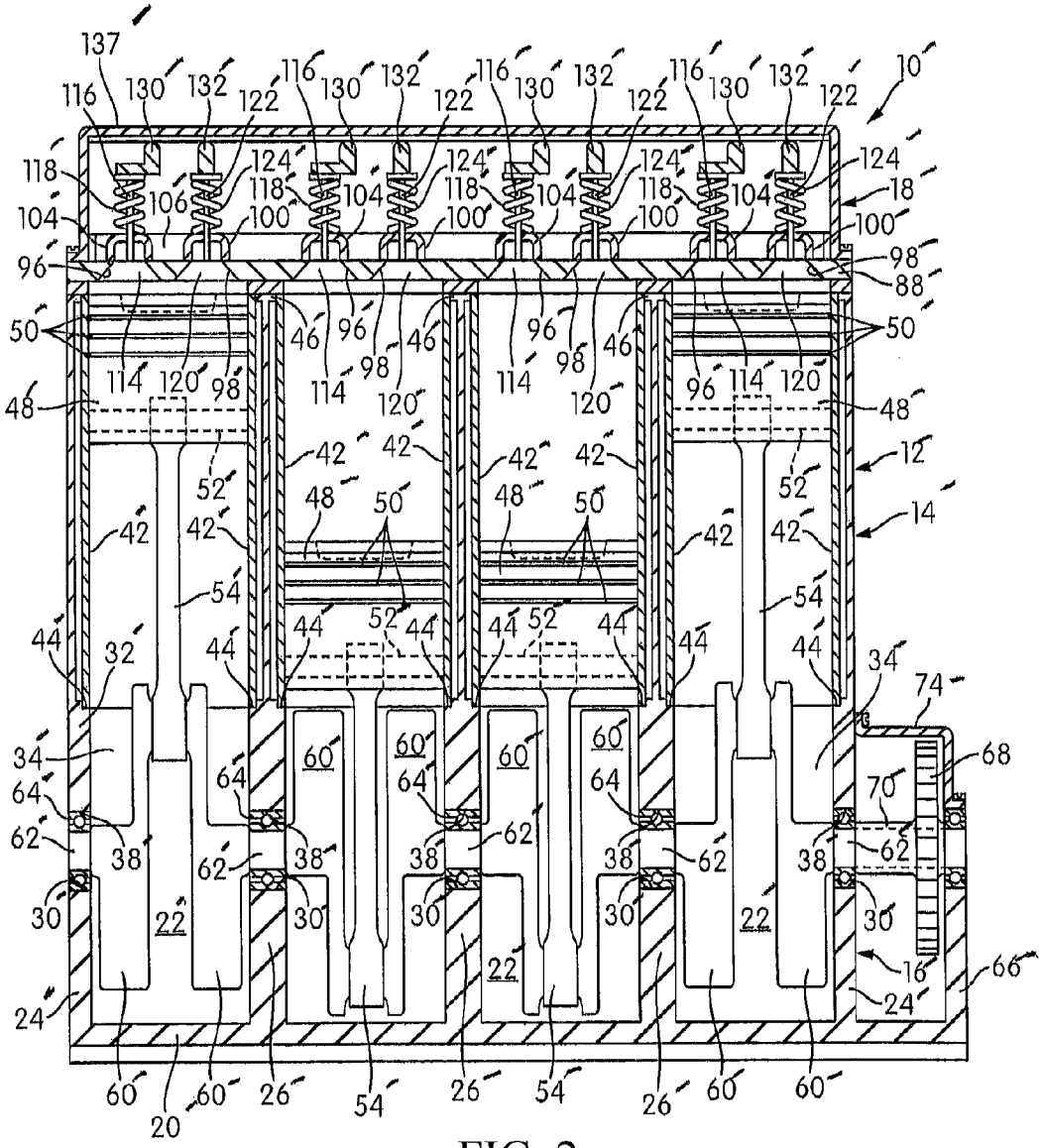
FIG. 2 is a sectional view taken along the line 2-2 of FIG. 1.

FIGS. 1-8 show an embodiment of the invention in the form of an inverted V-eight cylinder internal combustion engine, generally indicated at 10', which embodies the principles of the present invention. The engine 10' includes a frame structure, generally indicated at 12', which includes a main block section 14', a lower pan section 16' and an upper head assembly 18'. The lower pan section 16' serves as a support for the main block section 14'. As shown in FIGS. 1 and 2, the pan section 16' includes a bottom wall 20' having spaced side walls 22' extending upwardly therefrom and spaced end walls 24' extending upwardly from the bottom wall 20' between the ends of the side walls 22'. As best shown in FIG. 2, extending between the side walls 22', inwardly of the end walls 24' are four equally spaced parallel inner walls 26'.

The end walls 24' and parallel inner walls 26' of the lower pan section 16' have upwardly facing planar surfaces interrupted by longitudinally aligned spaced pairs of upwardly facing 180° arcuate bearing engaging surfaces 30'.

The main block section 14' includes a lower portion defined by exteriorly flanged upwardly and inwardly sloping side walls 32' vertically aligned with the side walls 22', upright end walls 34' vertically aligned with the end walls 24' of the lower pan section 16' and four interior walls 36' vertically aligned with the four inner walls 26' of the lower pan sections. The vertically aligned walls 32', 34' and 36' of the block section 14' have downwardly facing surfaces which engage the upwardly facing wall surface of pan section 16'. Suitable fasteners 38' extending through the flanges of the exteriorly flanged upright walls 32' of the lower portion of the block section 14' and into the aligned side walls 24' of the lower pan section 16 serve to fixedly the block section 14' on the lower pan section 16'.

The lower portion of the main block section 14' does not have downwardly facing surfaces which engage the 180° arcuate surfaces 30' of the lower pan section 16', instead the lower portion of the block section 14' has downwardly facing 180° arcuate bearing engaging surfaces 38 in alignment with the arcuate surfaces 30' of the lower pan section 16'.

The main block section 14' also includes a main upper portion configured to receive therein two banks of piston and cylinder assemblies, generally indicated at 40' which diverge downwardly from the top of the block section 14'. Each of the two banks include four cylinders 42'. The lower end of each cylinder 42' seats in surfaces 44' provided in the block section 14' to engage the lower end surface and exterior marginal lower end surface of each cylinder 42'.

The upper extremities of the cylinders 42' are fixedly engaged within openings formed in a sheet metal plate 46'. The plate 46' is essentially rectangular in shape bent along its longitudinal center line to form two longitudinally elongated areas having upper surfaces forming a shallow angle therebetween.

As best shown in FIG. 1, each piston and cylinder assembly 40' also includes a piston 48' mounted within an associated cylinder 42' for reciprocating axial movement in sealing engagement with the interior surface thereof as by piston rings 50'. Each piston 48' is pivotally connected, as by wrist pins 52', with the upper end of a piston rod 54'. The lower end of each piston rod 54' is pivotally connected to a shaft bright portion of a U-shaped crank section 56' of a crankshaft, generally indicated at 58'. Extending in vertical alignment with the legs of each U-shaped crank section 56' are counterweight sections 60'. Since the piston and cylinder assemblies 40 diverge downwardly in two banks, there are two duplicate crank shafts 58', one for each bank.

Each crankshaft 58' includes axially aligned cylindrical bearing sections 62' at each end thereof and between adjacent crank sections 56'. The cylindrical bearing sections 62' have exterior surfaces thereof engaged with the interior surfaces of special separable bearings 64'. The exterior surfaces of which are engaged by corresponding mating 180° arcuate surfaces 30' and 38'. In this way, the two horizontally spaced crankshafts 58' are mounted for rotational movement on the frame structure 12' about parallel horizontally extending axes.

Figure 5:
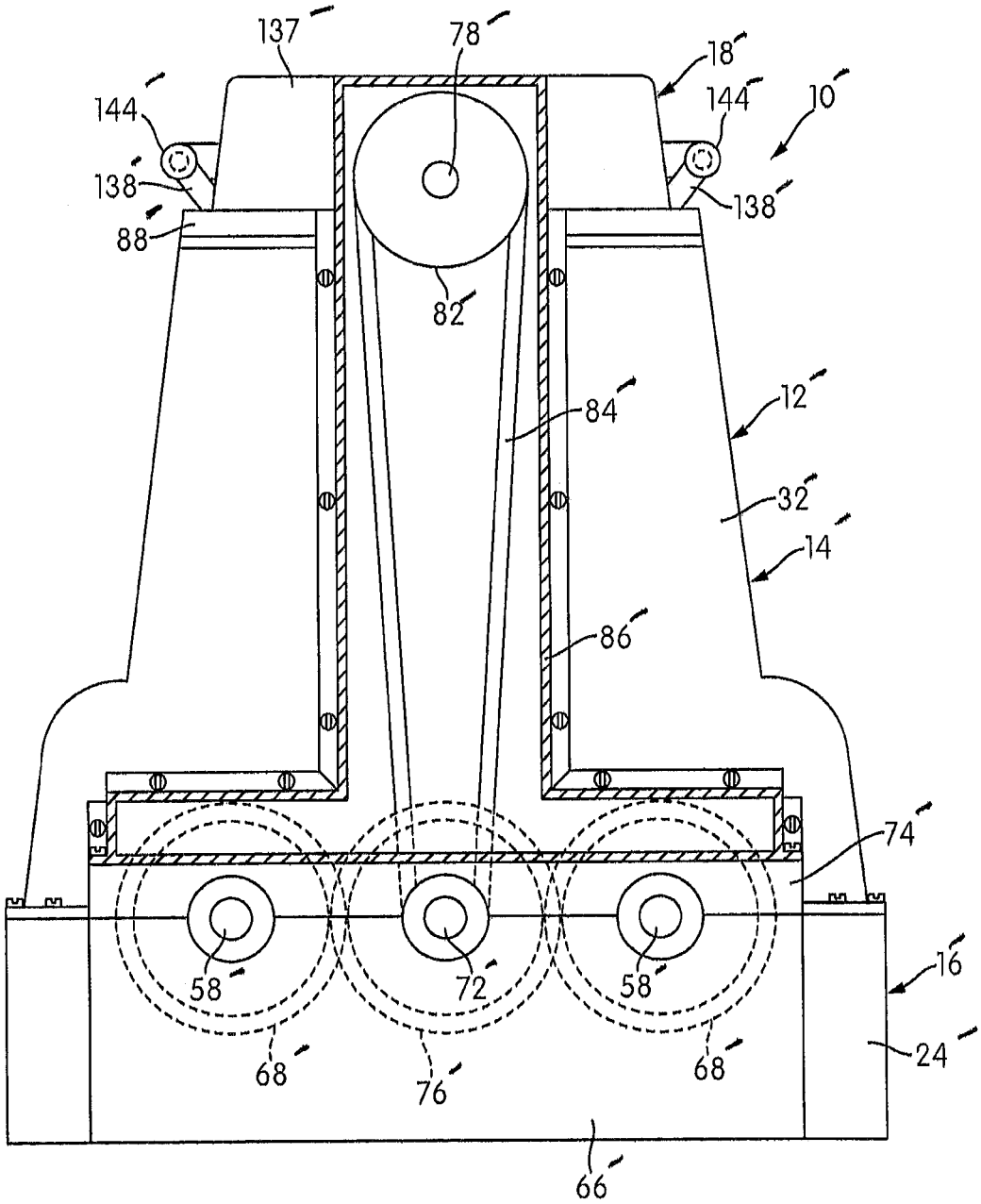
FIG. 5 is a right side elevational view of the engine shown in FIGS. 1-4 with the cam drive guard shown in section.

Referring now more particularly to FIGS. 2 and 5, it can be seen that the cylindrical section 62' at the right end of each crankshaft 58' extends beyond the associated end walls 24' and 32' and has a spaced extremity supported on a wall extension 66'. Between the end walls 24' and 32' and the wall extension 66', each cylindrical end section 62' has mounted thereon a gear 68' and spacer 70'.

Figure 4:
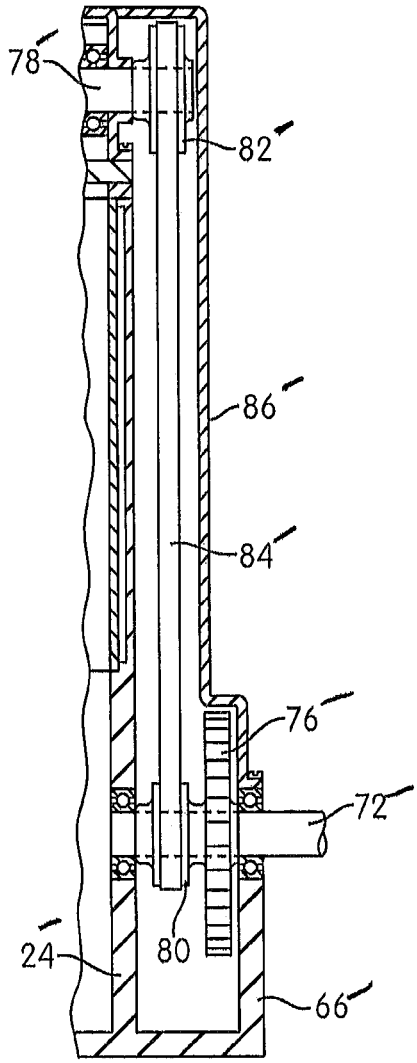
FIG. 4 is a fragmentary sectional view taken along the line 4-4 of FIG. 3.
Figure 6:
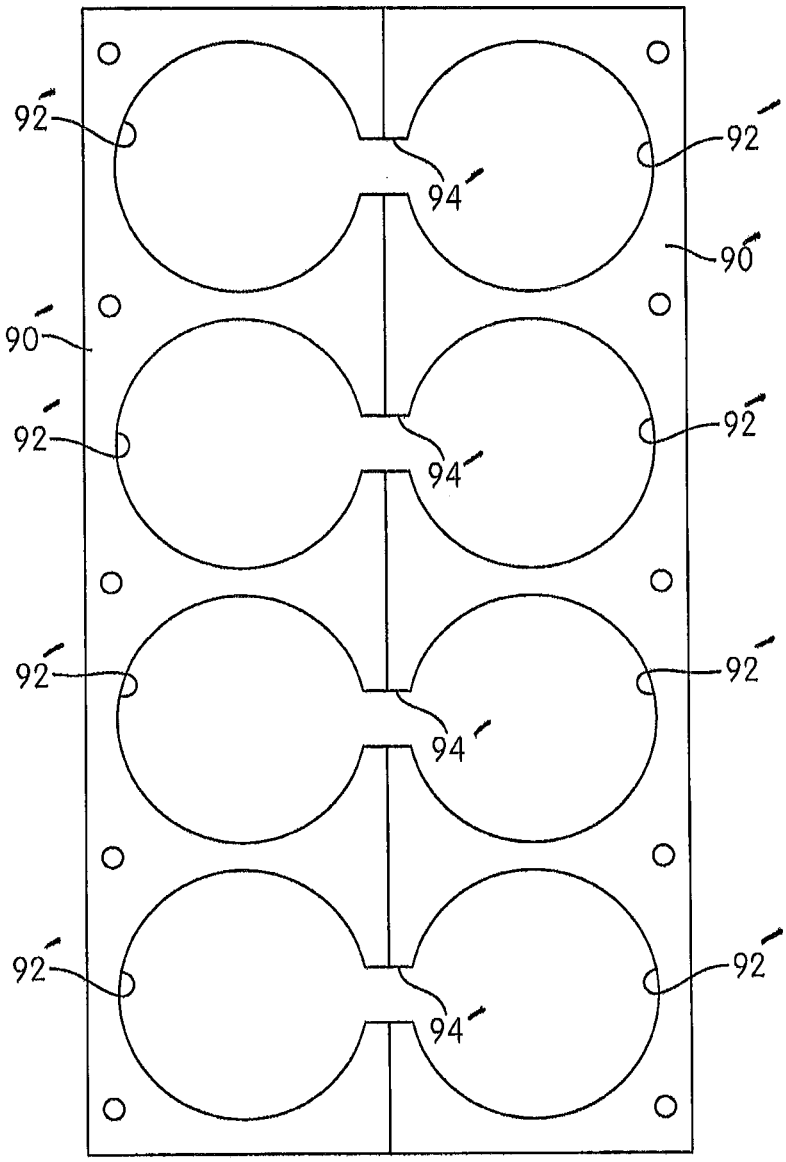
FIG. 6 is a layout view of the gasket of the engine viewed perpendicularly to the two angulated surface thereof.

As best shown in FIGS. 4 and 6, a main output stub shaft 72' has an inner end thereof suitably journed between the end walls 24' and 32' in spaced relation between the crankshafts 58' and extends outwardly beyond the wall extension 66'. Mounted in vertical alignment with the wall extension 66' is an end cap wall extension 74' which, when fixed to the wall extension 66', provides with the wall extension 66' bearing support for the outwardly extending end of the stub shaft 72' as well as the associated extremities of the two crankshafts 58'.

Fixed on the stub shaft 72' in meshing relation between the two gears 68' on the crankshaft 58' is a third gear 76' enabling the stub shaft 72' to act as a main rotational output for the engine 10' when the crankshafts 58' are operated by the operation of the two banks of piston and cylinder assemblies 40'.

As best shown in FIG. 5, the stub shaft 72', which rotates at the same speed as the crankshafts 58', is used to drive a cam shaft 78' at a speed one half the common speed of the stub shaft 72' and crankshafts 58'. A sprocket and chain assembly may be used for this purpose, however, as shown in the assembly employed is a timing gear and pulley assembly including a small timing gear 80' fixed to the stub shaft 72', a double size timing gear 82' fixed on the camshaft 78' and an endless timing belt 84' trained about the timing gears 80' and 82'. The entire timing belt assembly 80', 82' and 84' is encased in a flanged timing belt guard 86' fixed to the associated end wall 32'.

Figure 3:
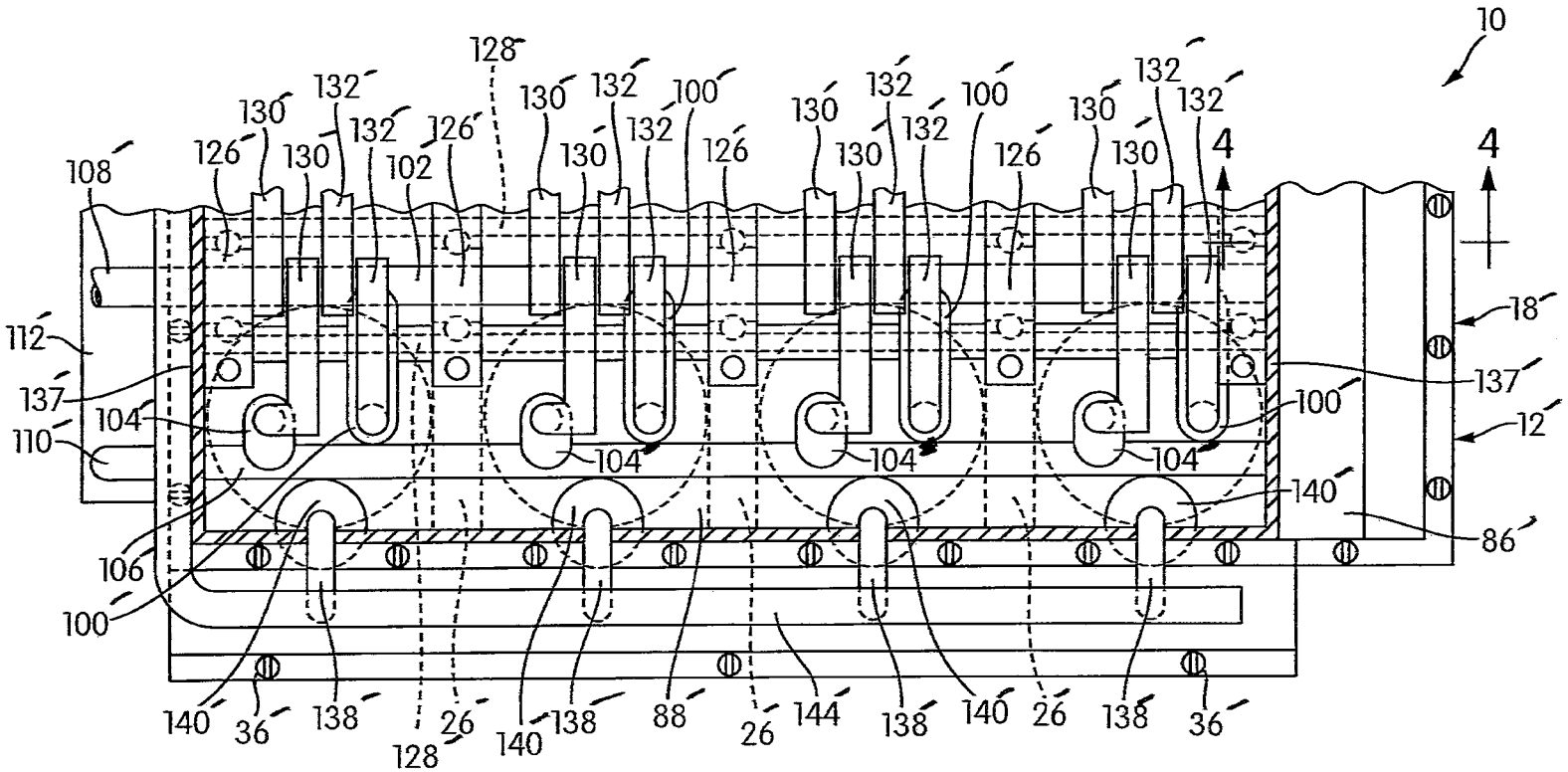
FIG. 3 is a fragmentary sectional view taken along the line 3-3 of FIG. 1.

Referring now more particularly to FIG. 3, the camshaft 78' is journaled in and forms a part of the head assembly 18'. The head assembly 18 includes a lower slightly angulated flat slab 88' having a lower surface which is complementary to the upper surface of the angulated plate 46'.

An angulated gasket, generally indicated at 90', is fixed by suitable fasteners between the upper angulated surface of the plate 46 and the lower angulated surface of the slab 88'.

Referring now to FIG. 6, the gasket 90' is in angulated plate form and includes a series of four paired openings 92'. Extending between each pair of openings 92' is a passage forming cut out 94', when the gasket 90' is in final fixed relation between the plate 46' and slab 88', the four paired openings 92' communicate respectively with the upper ends of the four paired cylinders 42' so that the cut outs 94' provide a passage between each pair of paired cylinders 42'. That is, instead of the passage communicating a pair of adjacent cylinders 42' within the same bank, the passage herein communicates a pair of closely spaced cylinders (combustion chamber) from the two different banks.

Again referring to FIGS. 1 and 3, the slab 88', which closes the upper end of the cylinders 42', has formed therein an inlet opening 96' leading into a combustion chamber portion in the upper end of each cylinder 42' and a spaced outlet opening 98' leading from the combustion chamber in the upper end of each cylinder 42'.

Extending over each outlet opening 98' from the upper surface of the slab 88' is a tubular structure 100' along the upper surface of slab 88' which leads inwardly to a central longitudinally extending tubular structure 102' defining an exhaust manifold for the engine.

Similarly, each inlet opening 96' has a tubular structure 104' disposed thereover on the upper surface of the slab 88'. The tubular structures 104' in one bank of cylinders extend away from the tubular structures 104' in the other bank. The outward ends of each bank of tubular structures 104' communicate with a manifold defining longitudinally extending tubular structure 106'.

As best shown in FIG. 3, an exhaust pipe 108' is connected to an open end of the exhaust manifold structure 102' and extends beyond the left end of the head assembly 18'. The two parallel inlet manifold structures 106' have one end correspondingly open to which are connected elbow pipes 110' leading to a centrally located inlet air filter assembly 112'.

Each inlet opening defines a downwardly facing frustoconical valve seat. An inlet valve 114' is mounted for movement with respect to each seat between an open position spaced from the seat and a closed position engaging the seat. Each inlet valve 114' includes a valve stem 116' extending upwardly therefrom through the associated inlet tubular structure 100. Surrounding the outwardly extending end of each inlet valve stem 116' between a washer fixed on the outward extremity of the valve stem 116' and the exterior of the associated inlet tubular structure 100' is a coil spring 118' which serves to spring bias the associated inlet valve 114' into its closed position.

In a similar manner, an outlet valve 120' with valve stem 122' and surrounding coil spring 124' is spring bias into a closed position with respect to each outlet opening 98'.

The inlet valves 114' and outlet valves 120' are moved out of their spring biased closed positions into their open positions by the operation of the camshaft 78'.

As best shown in FIG. 3, the camshaft 78' is rotatably supported in the head assembly 18' by a plurality of longitudinally spaced split supports 126' which also serve to fixedly support two rocker shafts 128' in a parallel relation to the camshaft 178' on opposite sides thereof.

The four inlet valves 114' in each bank are moved into their open positions by a corresponding four inlet rocker arms 130' pivotally mounted on an associated rocker shaft 128' and the four outlet valves in each bank are moved into their open positions by four outlet rocker arms 132' pivotally mounted on an associated rocker shaft 128'. To enable side by side rocker arms on each shaft to actuate longitudinally aligned valves of a valve engaging end of one of the adjacent rockers includes a longitudinally bent end.

The rocker arms 130' and 132' are mounted on their associated rocker shaft 128' so that the pivotal axis of each extends through a central portion thereof so that opposite free ends thereof can be engaged with the camshaft 78' and the washer fixed to the upper end of an associated valve 114' or 120'.

Each inlet valve 114' is moved into its open position at an appropriate time in the normal four stroke cycle occurring in the associated cylinder when the associated inlet rocker arm 130' is engaged by an inlet cam lobe 134' on the camshaft 78 and each outlet valve 120' is moved into its open position at an appropriate time in the normal four stroke cycle occurring when the associated outlet rocker arm 132' is engaged by an outlet cam lobe 136 on the camshaft 78'.

The head assembly 18' including the air inlet system up to the elbow pipes 110', the exhaust system up to the exhaust pipe 108', the camshaft 78' and mount 126' up to the end on which timing gear 82' is mounted and all of the rocker arms 130' and 132', the rocker shafts 128', valve stents 116' and 122' and valve springs 118' and 124' are enclosed within a cover member 137' having its lower open end provided with an exterior peripheral mounting flange through which the cover member 137' is bolted to the upper periphery of the slab 88'.

Figure 7:
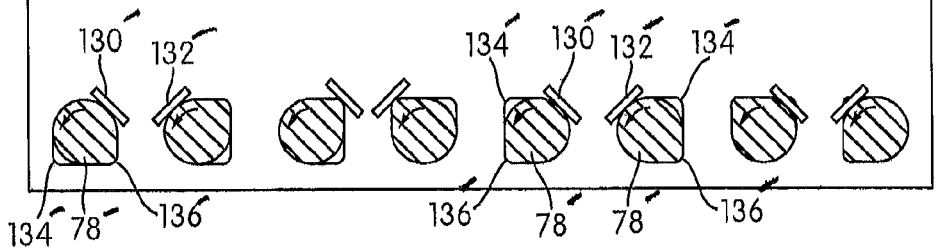
FIG. 7 is a chart designating the direction of piston movement and cycle events for each piston and cylinder assembly of the engine including corresponding cross-sections of the camshaft.

Referring now more particularly to FIG. 7; there is shown therein a chart showing for each of four consecutive 180° rotational movements of the crankshafts 58', the direction of piston movement, either up-U or down-D, for each piston and cylinder assembly 40' and the cycle event—CE (F=fire, E=exhaust, I=inlet, C=compression) occurring in each piston and cycling assembly 40'.

The chart also includes for each piston and cylinder assembly 40', an illustrations of the configuration of the camshaft. The illustrations show the relative circumferential position on the camshaft of the exhaust cam lobes in cross section and the related inlet cam lobes in elevation to indicate the opening of the exhaust valves during the exhaust event and the opening of the inlet valves during the inlet event without regard to their exact beginning or end which is in accordance with accepted practice.

Each communicated pair of piston and cylinder assemblies 40' is fired together for one 180° turn during each of four consecutive 180° turns of the crankshafts 58' and the firings of a different pair take place in each of the four consecutive 180° turns. As shown, the order of firing is 1-3-4-2.

Figure 8:
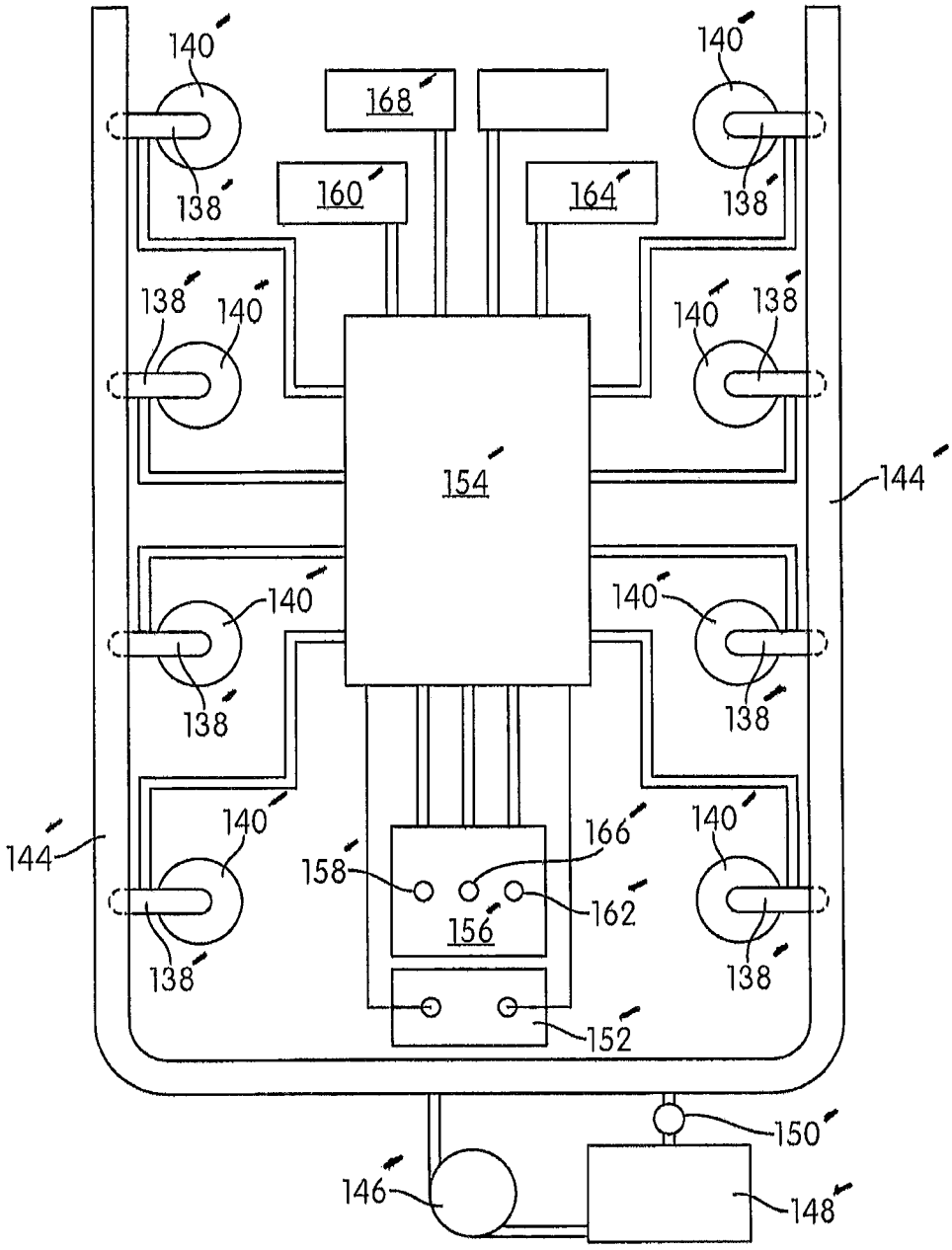
FIG. 8 is a somewhat schematic view of the fuel injecting system and the computer system for controlling the fuel injecting system.

Referring now more particularly to FIG. 8, there is shown therein the manner in which fuel injection skipping is applied to each double firing event of each pair of piston and cylinder assemblies 40' in accordance with the invention.

FIG. 8 illustrates an injector 138' for each piston and cylinder assembly 40' in their relative positions, each injector 138' is preferably of the type having a cylindrical body with a conical ejecting nozzle which is opened and closed by an electrically actuated solenoid valve. As shown each injector body has angulated exterior circular mounting flange which fits within a mating recess in the upper surface of the slab 88'. A nozzle recess extends from each mating recess through the slab 88. In this way, the nozzle of each injector 138' is positioned to inject fuel there through into the associated combustion chamber in the direction of a swirl chamber 142' formed in the upper surface of the associated piston 48 when in its top dead center position.

Injecting fuel into a swirl chamber 142' in the piston 48' is characteristic of diesel operation. Wherein the compression ratio of each piston and assembly 40 is such that at the end of the compression event, the air in the combustion chamber is at a temperature and pressure to cause auto ignition when the fuel is injected therein.

While the engine 10' is shown as being diesel operate with compression ignition, the engine could be made to operate on a conventional spark ignition basis with a lesser compression ratio and a positioning of the fuel injectors with mating air injectors to direct an appropriate air fuel mixture into the combustion chamber through the open inlet valve during the inlet stroke.

It will also be understood that while the engine is disclosed as inverted V-8, it could be made into an inverted V-6 by appropriate changing the crank portions of the crankshafts from the 180° shown to 120°. Other numbers of pistons/cylinders are possible.

Referring now back to FIG. 8 of the drawings, the cylindrical end of each injector 138 opposite of its nozzle is connected to a fuel containing manifold 144'. The fuel in the manifold 144' is maintained at a predetermined pressure by the output of a pump 146' drawing fuel from a supply 148' which is connected to manifold through a pressure relief valve 150'.

The opening and closing of the solenoid valves determines the amount of fuel injected by each of the injectors 138'. The solenoids are normal spring biased into a closed position and opened when the solenoid valves are electrically energized.

It can thus be seen that there has been provided an internal combustion engine having two banks of four piston and cylinder assemblies arranged in an inverted V configuration so that there are four pairs of assemblies, each pair having cylinders with adjacent combustion chambers intercommunicated by a passage extending there between; crank shaft driven pistons in said cylinders movable within the combustion chambers thereof through successive cycles each including a compression stroke followed immediately by a power drive stroke; and a computer controlled fuel injector capable of being selectively controlled to operate either to inject fuel into (1) both cylinders of a pair to establish therein a double fire single expansion mode, or (2) into only one cylinder of a pair to establish therein a single fire double expansion mode.

Preferably, when operating in mode (2), the one cylinder receiving the injection is alternated between the pair every predetermined number of piston cycles. The predetermined number of piston cycles is within a range of 1 to 10 piston cycles with a preferred example being 5 piston cycles. Variation in the numbers can be made with each alternation.

The present invention includes a method of operating the inverted V-8 engine as a prime mover of a vehicle having a cruise control system manually actuated to effect automatic movement of a normally manually moved accelerator pedal either in (1) a normal mode wherein the amount of fuel injected is maintained substantially at an optimum level and power variation is obtained in response to manual pedal movements by varying the relative number of injector pairs operating in modes (1) or (2) in a cruise control mode wherein all four injector pairs operate in mode (2) and power variation is obtained in response to automatic pedal movements by varying the amount of fuel injected.

In the normal mode, the optimum level of fuel injection is the minimum required to achieve idling when the vehicle to stationary or coasting when the vehicle is in motion. The amount of fuel injected is maintained substantially the same although some variation is contemplated to smooth out the transition which can take place with each change. The optimum level occurs when the accelerator pedal is in a normal or not depressed position and all four pairs of assemblies are in mode (2). As the accelerator pedal is depressed the four pairs of assemblies change one after another from mode (2) to mode (1). After all four pairs have been changed to operate in mode (1), further depression of the accelerator pedal will result in a progressive increase in the amount of fuel injected.

When operating in the cruise control mode the manual actuation of the cruise control system not only sends signals to the computer to effect the operations specified but also to obviate the responses to the accelerator pedal movement which would occur when in the normal mode and vice versa.

The description above refers to alternating the one cylinder receiving the injection when two cylinders are operatively receiving an injection and a skipped injection. This alternating method of proceeding is preferred because it achieves more uniform heat balance and more even part wear between the two assemblies involved. The alternation preferably is programmed to take place every predetermined number of piston cycles. The predetermined number of cycles can be any number. A preferred range of number of cycles is 1-10 with five being a preferred number.

It will be understood that the engine may be provided with a conventional lubricating and cooling system.

It should be appreciated that the foregoing embodiment(s) have been illustrated solely for the purposes of illustrating the structural and functional advantages of the present invention and is not intended to be limiting. To the contrary, the present invention includes all modifications, alterations, substitutions and equivalents within the spirit and scope of the appended claims.

The invention claimed is:

1. An internal combustion engine comprising: two banks of four piston and cylinder assemblies arranged in an inverted V configuration so that there are four pairs of assemblies; wherein each pair of cylinders has an assembly from each bank; each pair having cylinders with adjacent combustion chambers intercommunicated by a passage extending therebetween, crank shaft driven pistons in said cylinders movable within the combustion chambers thereof through successive cycles each including a compression stroke followed immediately by a power drive stroke and computer controlled fuel injectors configured to be selectively controlled to operate either to inject fuel into (1) both cylinders of a pair to establish therein a double fire single expansion mode (1) and (2) into only one cylinder of a pair to establish therein a single fire double expansion mode (2).

2. An internal combustion engine as defined in claim 1 wherein when said computer controlled injectors are operating in mode (2) the one cylinder receiving the injection is alternated between the pair every predetermined number of piston cycles.

3. An internal combustion engine as defined in claim 2 wherein the number of piston cycles is within the range of between 1 and 10.

4. An internal combustion engine as defined in claim 3 wherein the number of piston cycles is 5.

5. An internal combustion engine as defined in claim 1 wherein fuel is injected into an associated cylinder by an associated injector during a time near the end of the piston compression stroke when air in the cylinder has been compressed to an auto ignition pressure to create an air fuel mixture which is ignited by the fuel injection itself.

6. An internal combustion engine as defined in claim 1 wherein fuel is injected into an associated cylinder by an associated injector during a piston air intake stroke precede the piston compression stroke so that a compressed air-fuel mixture is formed in the associated cylinder near the end of the piston compression stroke which is ignited by energizing a spark plug in contact therewith.

* * * * *